US007398968B2

(12) United States Patent
Learmonth et al.

(10) Patent No.: US 7,398,968 B2
(45) Date of Patent: Jul. 15, 2008

(54) IMAGING APPARATUS

(75) Inventors: Murray Learmonth, Temecula, CA (US); William H. Schwiebert, Poway, CA (US); Samuel Albert Massey, San Diego, CA (US); Rich Lin, ShenKeng Shiang (TW); King Lin, Taipei (TW)

(73) Assignee: Hewlett-Packard Development Company, L.P., Houston, TX (US)

( * ) Notice: Subject to any disclaimer, the term of this patent is extended or adjusted under 35 U.S.C. 154(b) by 523 days.

(21) Appl. No.: 10/978,668

(22) Filed: Nov. 1, 2004

(65) Prior Publication Data

US 2006/0104655 A1 May 18, 2006

(51) Int. Cl.
*B65H 5/22* (2006.01)

(52) U.S. Cl. ..... 271/3.14; 271/145; 271/162; 271/207; 271/213; 347/104

(58) Field of Classification Search ..... 271/3.14, 271/145, 162, 164, 207, 213, 220; 347/104
See application file for complete search history.

(56) References Cited

U.S. PATENT DOCUMENTS

| | | | | |
|---|---|---|---|---|
| 4,958,950 | A | 9/1990 | Kobayashi et al. | 400/629 |
| 5,105,210 | A * | 4/1992 | Hirano et al. | 346/145 |
| 5,419,543 | A | 5/1995 | Nakamura et al. | 271/9.01 |
| 5,727,464 | A | 3/1998 | Bahrami et al. | 101/216 |
| 6,004,053 | A | 12/1999 | Petteruti et al. | 400/693 |
| 6,205,297 | B1 | 3/2001 | Tachibana et al. | 399/21 |
| 6,757,501 | B2 | 6/2004 | Mochizuki et al. | 399/18 |
| 6,848,685 | B2 * | 2/2005 | Katsuyama | 271/162 |
| 7,258,334 | B2 * | 8/2007 | Cheng | 271/3.14 |
| 2003/0052956 | A1 * | 3/2003 | Katsuyama | 347/108 |
| 2004/0017460 | A1 * | 1/2004 | Kagami et al. | 347/104 |
| 2005/0062217 | A1 * | 3/2005 | Asada | 271/162 |

* cited by examiner

*Primary Examiner*—David H Bollinger

(57) ABSTRACT

An imaging apparatus includes a housing having a cavity therein, a linkage arm disposed within the cavity, an input media tray movably latched to the housing, and an input media tray latch coupled to the linkage arm and releasably engaged with the input media tray. Moving the linkage arm places the imaging apparatus in an operational mode, and releases the input media tray latch and unlatches the input media tray from the housing.

24 Claims, 9 Drawing Sheets

IMAGING APPARATUS

BACKGROUND

Consumers generally have limited amounts of space to devote to computing resources. Business owners also have limited amounts of space to devote to computing equipment. Printers are computing items that occupy desk space. Many features of computing products are considered when making a buy decision. Most consumers and most business concerns seek equipment that is adequate to accomplish a particular task for a given cost. Another aspect of a product that is considered by businesses and consumers is the amount of space the product uses. Generally, consumers and businesses may choose a device with a smaller footprint, given a choice between two otherwise similar devices. The footprint is the amount of floor space or desktop space taken up by the product.

Generally, users complete a number of steps before using an imaging apparatus. For example, an input or output paper tray is deployed and power to the imaging apparatus is enabled. Passing through a number of steps in order to "setup" the imaging apparatus takes time. Consumers may not choose to purchase products that are less efficient, those products that take a large amount of time to set up and a large amount of space.

DETAILED DESCRIPTION

In the following detailed description of the embodiments, reference is made to the accompanying drawings that form a part hereof, and in which are shown by way of illustrating specific embodiments in which the invention may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of present embodiments. The following detailed description, therefore, is not to be taken in a limiting sense, and the scope of various embodiments of the invention is defined only by the appended claims, along with the full range of equivalents to which such claims are entitled.

Figure 1:
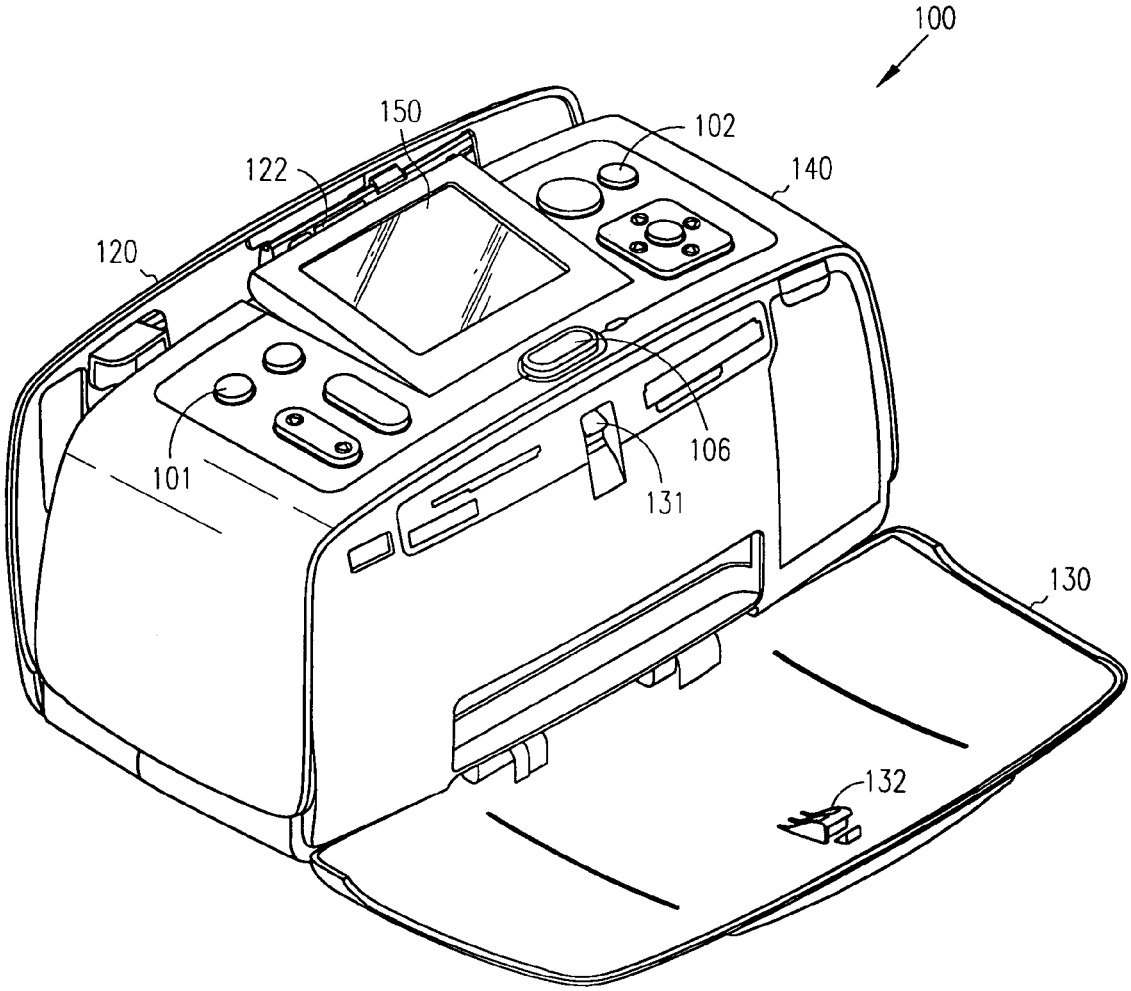
FIG. 1 is a perspective view of an imaging apparatus having an input media tray and an output media tray in an open or deployed position, according to an example embodiment.

FIG. 1 is a perspective view of an imaging apparatus 100, according to an example embodiment. The imaging apparatus includes a housing 140. The housing 140 includes an input media tray 120 and an output media tray 130. The input media tray and the output media tray are pivotally attached to the housing 140. As shown in FIG. 1, the input media tray 120 and the output media tray 130 are in an open or deployed position. The housing 140 also includes a user interface or display 150 pivotally attached to the housing 140. As shown in FIG. 1, the display 150 is in an elevated or deployed position. The housing may also include a first set of buttons 102, and a second set of buttons 104. The first set of buttons 102 and the second set of buttons 104 are used to control the imaging apparatus 100. The housing 140 also includes a front door latch mechanism which includes a front door latch 131. The output media tray includes a latch receiver 132. The front door latch 131 engages the latch receiver when the output media tray 130 is placed in a stowed position. When the front door latch 131 engages the latch receiver 132, the output media tray 130 remains in the stowed position (see FIG. 2) until the front door latch 131 is moved and disengaged from the latch receiver 132. The housing also includes a back door latch (see FIGS. 4 and 5) that engages a latch receiver 122 on the input media tray 120.

Also included within the housing 140 is a paper path or media path 134. The media path is the path along which media from the input media tray 120 travels through the housing and past an imaging mechanism 210 (see FIG. 3), to the output media tray 130.

The housing 140 may also include a button or an actuator 106 capable of at least two positions. The button or actuator 106 is attached to the front door latch 131 and the back door latch (see FIGS. 4 and 5). The button or actuator 106 is also attached to a mechanism for placing the imaging apparatus in an operational or operating mode or placing the imaging apparatus in a nonoperational or nonoperating mode. In some embodiments, the button or actuator 106 disables and enables power to the imaging apparatus to place the imaging apparatus in either the nonoperational mode (power off) or the operational mode (power on). The button or actuator 106 also may be connected to the display or user interface 150. Moving the button or actuator 106 also may move the display 150 from a stowed position to the deployed position. In some embodiments, depressing or moving the actuator 106 unlatches the input media tray 120, unlatches the output media tray 130, moves the user interface or display out of the stowed position and places the imaging device 100 in an operational mode.

Figure 2:
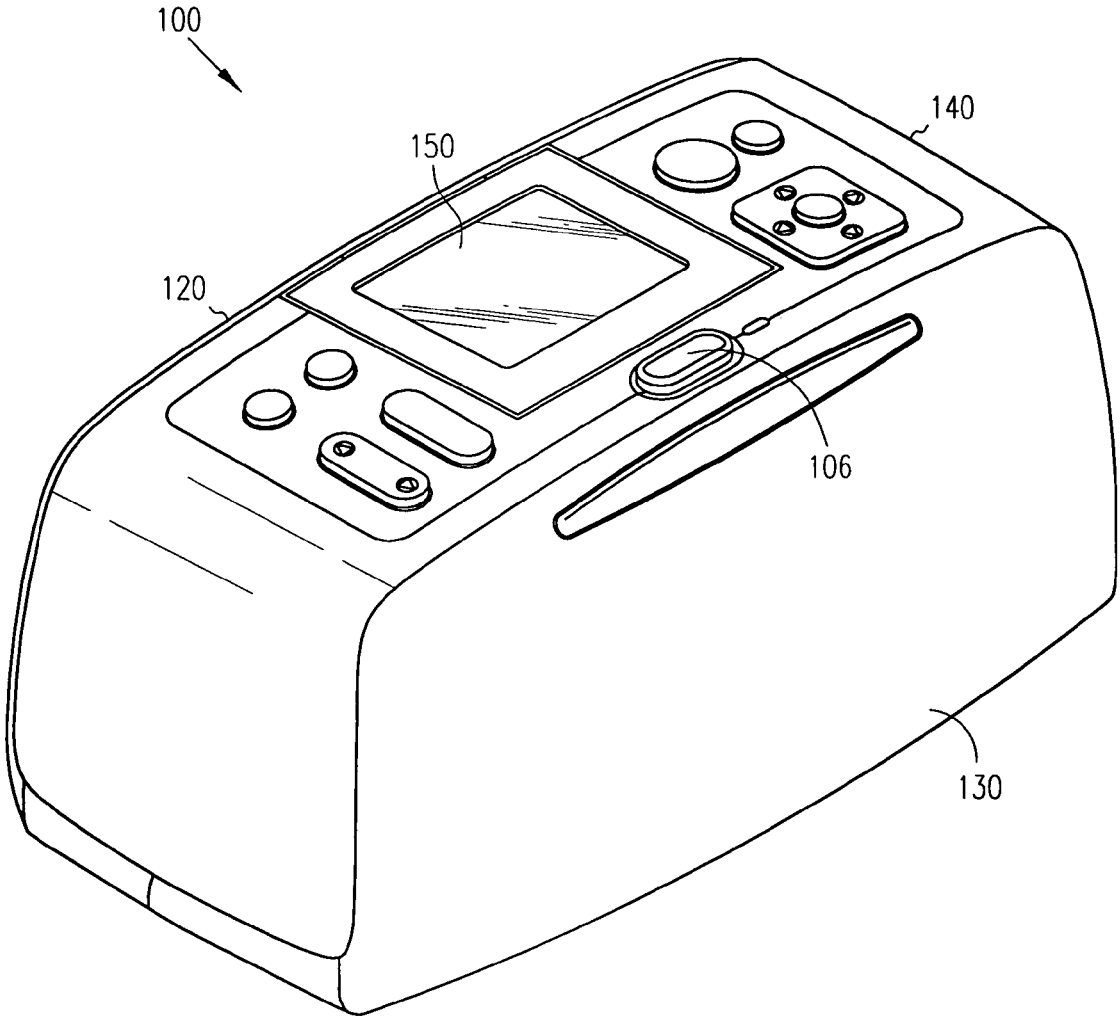
FIG. 2 is a perspective view of an imaging apparatus in which the input media tray and the output media tray are in a stowed position, according to an example embodiment.

FIG. 2 is a perspective view of an imaging apparatus 100 in which the input media tray 120 and the output media tray 130 are in the stowed position, according to an example embodiment. In the stowed position, the input media tray 120 and the output media tray 130 are positioned adjacent the housing 140. The display or user interface 150 is also positioned within the housing 140. The imaging apparatus 100 is in a nonoperational state. Power may be enabled in a nonoperational state. For example, the imaging apparatus may be placed in a sleep mode where a lower level of power is used when compared to the operational mode. In the nonoperational state, at least one of the input media tray 120 or the output media tray 130 is stowed and obstructs the media path through the imaging device 140. One of the input tray 120 and the output tray 130 is in a substantially vertical orientation in the stowed position.

In other embodiments of the imaging apparatus 100 either the input media tray or the output media tray can be in the substantially vertical orientation. The substantially vertical orientation means that a bed of the media tray, in this case the input media tray, is in the range of 80 to 90 degrees with respect to the horizon. The bed of the media tray holds the input media and, therefore, the media in the media input traymay also be in a substantially vertical orientation. In some embodiments of the substantially vertical orientation, the media tray is in the range of 80 to 90 degrees with respect to the horizontal, and still in further embodiments, the bed of the input media tray makes an angle in the range of 84 to 90 degrees with respect to the horizontal. However, the angle of either the input tray or the output tray may independently range from 0 to 90 degrees, depending upon the embodiment.

Figure 3:
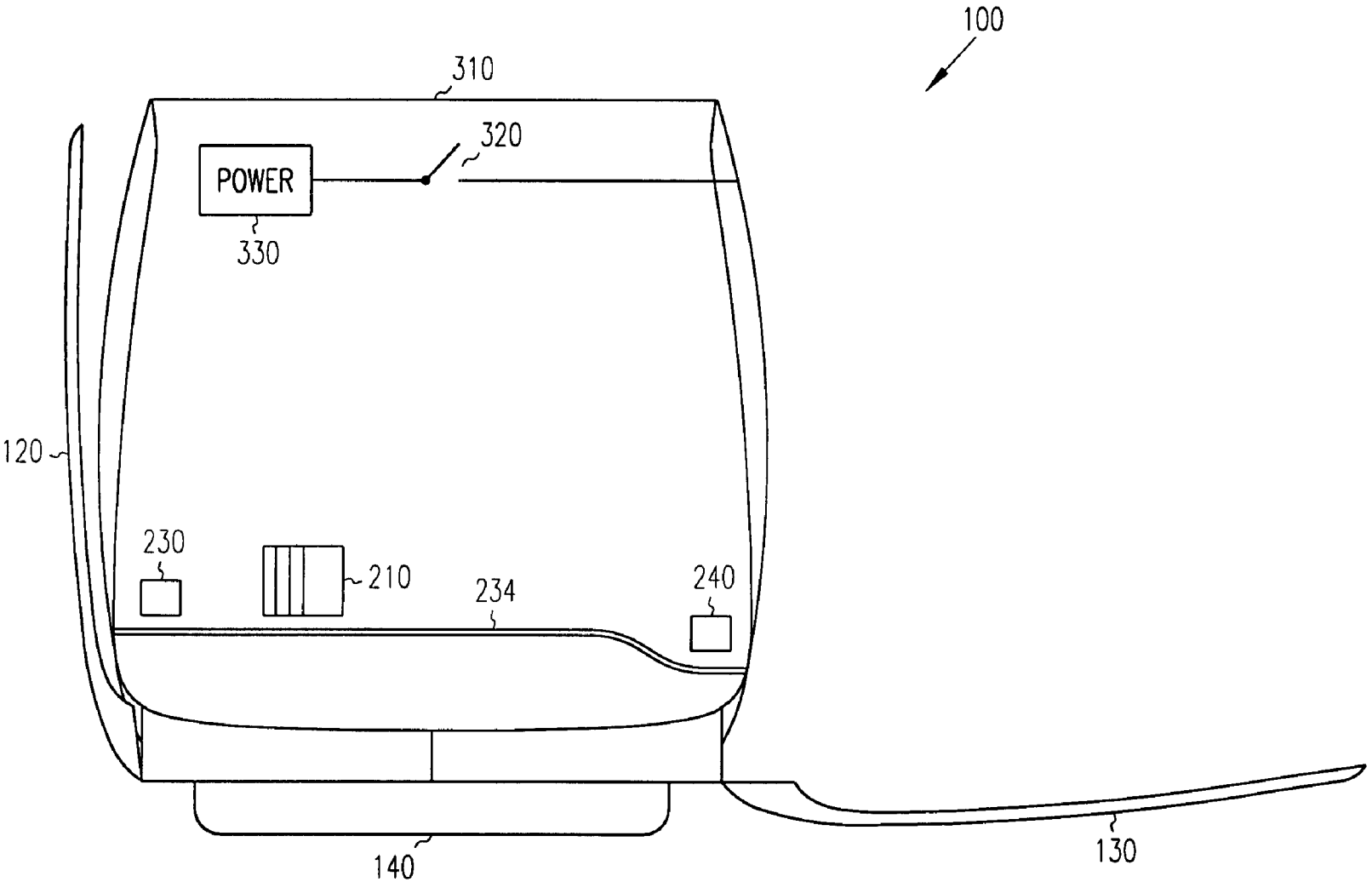
FIG. 3 is a schematic view of an imaging apparatus, according to an example embodiment.

FIG. 3 is a schematic view of an imaging apparatus 100 according to an embodiment of this invention. Within the housing is a media path 234. The media path 234 connects the input media tray 120 and the output media tray 130. Positioned near one of the input media tray 120 is a picking mechanism 230 for placing media on to the media path 234. The picking mechanism 230 is at one end of the path 234. The housing 140 includes an imaging device 210 or a fluid ejection device in some embodiments. The device 210 is positioned near the media path 234. As media passes over the media path 234, the device 210 places an image, prints, and/or ejects fluid on the media. The device 210 may include an inkjet printing device, a LaserJet printing device, and a laser printing device, for example. At the end of the media path 234 near the output media tray 130 is an ejection mechanism 240 that moves the media on to the output media tray 130. The imaging apparatus 100 also may include a first switch 310 and a second switch 320. Each of the first switch 310 and the second switch 320 may switch the imaging apparatus 100 to a nonoperational mode. As shown in FIG. 3, the first switch 310 and the second switch 320 may disable power from a source of power 330 associated with the imaging apparatus 100. Disabling or enabling power to the imaging apparatus is one way to switch between an operational mode and a non-operational mode.

Figure 4:
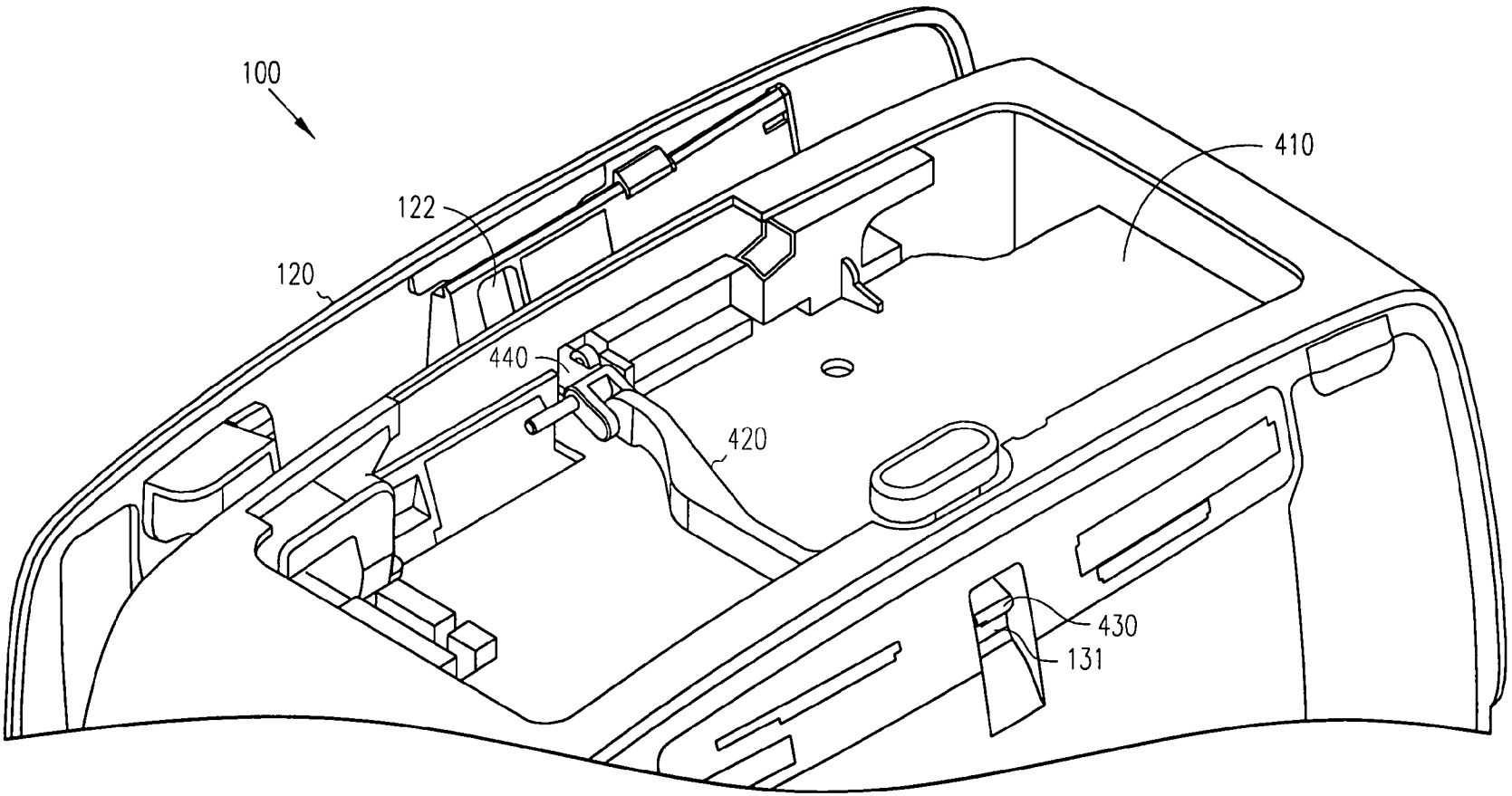
FIG. 4 is a top perspective view of an imaging apparatus with portions removed, according to an example embodiment.

FIG. 4 is a top perspective view of an imaging apparatus 100 with portions thereof removed, according to an example embodiment. Portions of the imaging apparatus shown in FIG. 4 are removed for the sake of more clearly showing other aspects of the example embodiment. The housing of the imaging apparatus 100 includes a cavity 410. Positioned within the cavity 410 is a linkage arm 420 in an embodiment. Pivotally attached to the linkage arm 420 is a front door latch mechanism 430 that includes a latch 131. In an additional embodiment, also pivotally attached to the linkage arm 420 is a back door latching mechanism 440. The button or actuator 106 may travel in a direction substantially transverse the linkage arm 420. The button or actuator 106 may be positioned within the housing so that depressing the button or actuator 106 moves the linkage arm 420. The linkage arm 420 may move downwardly when the button or actuator 106 is depressed.

Figure 5:
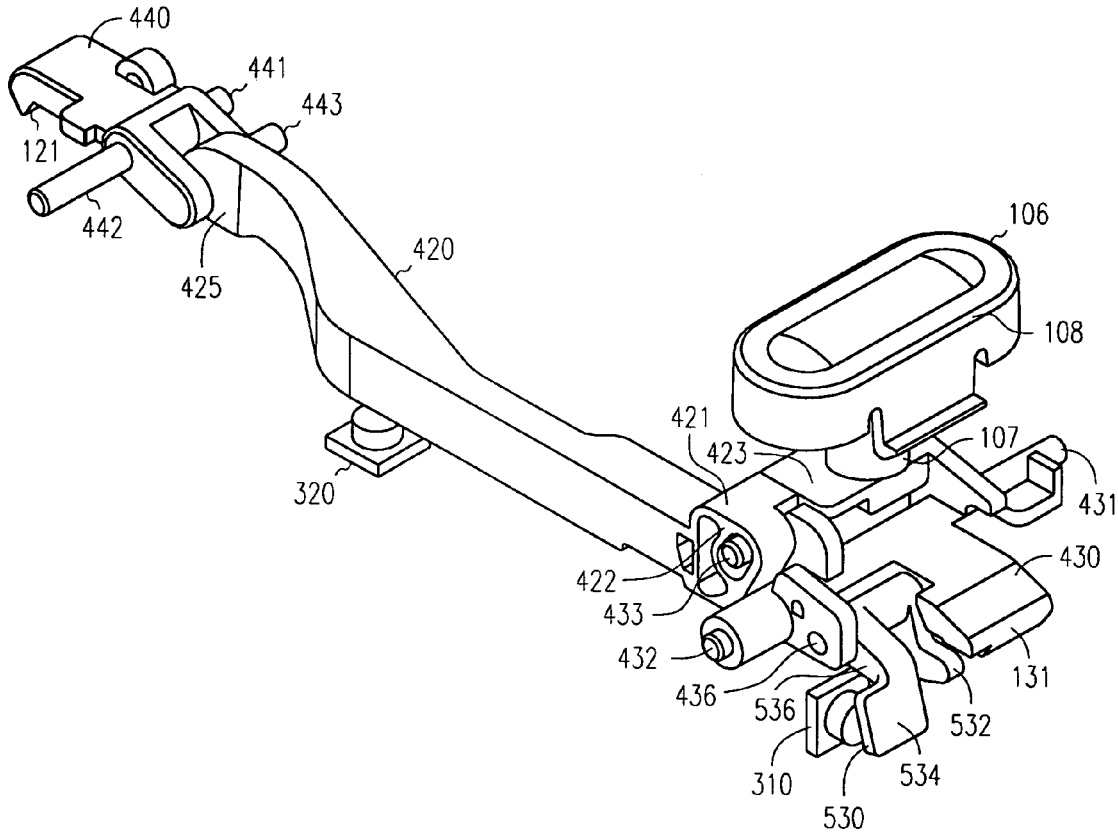
FIG. 5 is a perspective view of the linkage arm of the imaging apparatus, according to an embodiment of the invention.

FIG. 5 is a perspective view of the linkage arm 420 of the imaging apparatus 100, according to an embodiment of the invention. The linkage arm 420 is shown separate from the imaging apparatus 100 in this view. The linkage arm may include a first end 421 having an opening 422 for pivotally attaching the front door latching mechanism 430 thereto. The first end 421 also includes a platform 423 that extends from the first end 421. The platform 423 includes a flat surface. The linkage arm 420 also may have a second end 424 having an opening 425 for pivotally attaching the back door latching mechanism 440 to the linkage arm 420.

The front door latch mechanism 430 includes a first pivot shaft 431 and a second pivot shaft 432. The front door latch mechanism 430 couples with the housing 140 (see FIG. 4) at the first pivot shaft 431 and the second pivot shaft 432. The housing 140 may include openings for capturing the first pivot shaft 431 and the second pivot shaft 432. The front door latch mechanism 430 also includes a third pivot shaft 433. The third pivot shaft 433 is sized so as to fit within the opening 422 of the linkage arm 420.

Attached to the front door latch mechanism 430 may be a sensor assembly 530. The sensor assembly 530 includes a finger 532 and a paddle 534 attached to a shaft 536. The paddle 534 includes a flat surface. The sensor assembly 530 rotates with respect to the front door latch mechanism 430. The sensor assembly 530 may be pivotally attached to front door latch mechanism 430 via the shaft 436. The shaft 536 fits within openings in the front door latch mechanism 430, such as an opening 436. Positioned within the housing (see FIG. 3) at a location near the paddle 534 may be the switch 310. The paddle 534 may also be referred to as a switch engaging member.

Also shown in FIG. 5 is the button or actuator 106. The button or actuator 106 includes a base 107 and an enlarged shoulder portion 108. The base 107 is sized to contact the platform 423 and to impart a force on the platform 423 of the linkage arm 420 upon further movement of the button or actuator 106.

Still referring to FIG. 5, the back door latch mechanism 440 includes a first pivot shaft 441 and a second pivot shaft 442. The back door latch mechanism 440 is attached to the housing 140 (see FIG. 4) at the first pivot shaft 441 and the second pivot shaft 442. The housing 140 may include openings for capturing the first pivot shaft 441 and the second pivot shaft 442. The back door latch mechanism 440 also may include a third pivot shaft 443. The third pivot shaft 443 is sized so as to fit within the opening 425 of the linkage arm 420. The linkage arm 420 is pivotally attached to the back door latch 440 at the third pivot shaft 443. The back door latch mechanism 440 also includes a latch 121 that engages a catch on the input media tray 120.

A printed circuit card includes the second switch 320 as shown in FIG. 5. The switch 320 may be positioned below the linkage arm 420 along the length of the linkage arm. The switch 320 is shown in isolation. In operation, when the button or actuator 106 is moved to impart a force onto the platform 423, the linkage arm 420 may move downward and contacts the second switch, or a linkage arm switch 320. The linkage arm switch 320 energizes the imagining apparatus 100 or places the imaging apparatus into an operational state. Downward movement of the linkage arm 420 also may make the rear door latch 440 pivot about the shafts 441, 442. This in turn releases the latch 121 from the catch or latch receiver 122 on the input media tray 120. The input media tray 120 moves toward or to the deployed position. Downward movement of the linkage arm 420 also makes the front door latch 430 pivot about the shafts 431, 432. This in turn releases the latch 131 from the catch or latch receiver 132 on the output media tray 130. The output media tray 130 moves toward or to the deployed position.

In addition, downward movement of the linkage arm 420 also may move the user interface or display 450. The housing 140 includes at least one detente (not shown) positioned near the user interface or display 450. The user interface or display 450 is mounted to the housing 140 so that once the display is moved from the détente that holds the display in the stowed position, a spring, such as a leaf spring, may force the display or user interface 450 to the deployed position.

Figure 6:
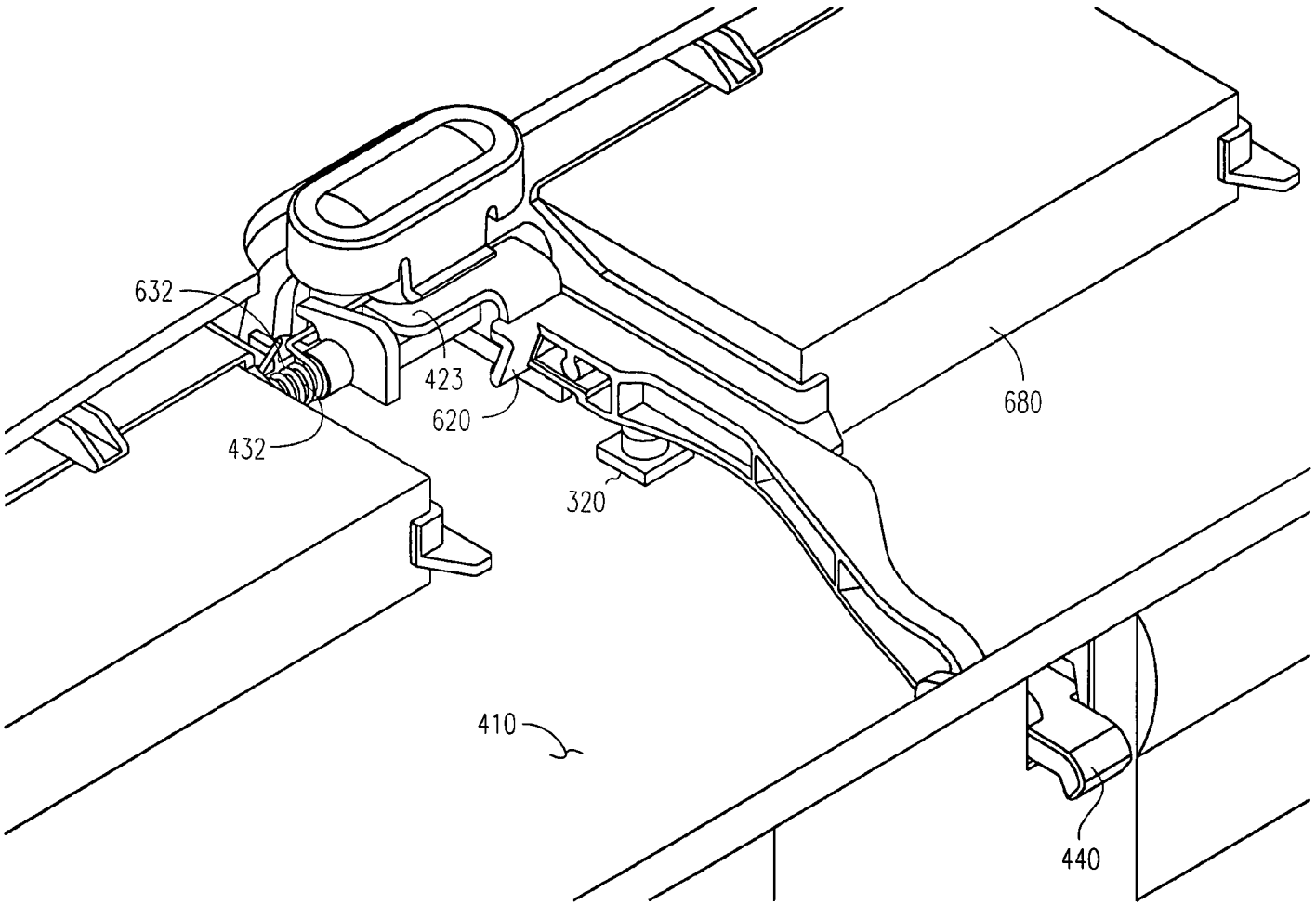
FIG. 6 is a top perspective view of an imaging apparatus with portions removed looking from the input media tray, according to an example embodiment.

FIG. 6 is a top perspective view of the imaging apparatus with portions removed looking from the rear door latch mechanism 440 for input media tray 120 (see FIG. 1) toward the output media tray 130 (see FIG. 1), according to an example embodiment. The display or user interface 450 has been removed from this view for the sake of clarity. The interface 450 may be received into the cavity 410. The cavity 410 includes the linkage arm 420 mounted to the housing 140. The cavity 140 includes a display connector (not shown), the linkage arm switch 320, and a card slot connector 680. The linkage arm switch 320 is mounted to a printed circuit board (not shown for the sake of clarity). The linkage arm 420 includes a ramp 620. Downward movement of the linkage arm 420 also may force the ramp 620 into engagement with a portion 720 (see FIG. 7) of the display or user interface 450. The ramp 620 may produce movement of the display or user interface 450 so as to remove the display or user interface 450 from the at least one detente in the housing 140.

Also shown in FIG. 6 is the shaft 432 of the front door latch mechanism 430. A spring 632 is positioned on the shaft and urges the front door latch mechanism 430 toward the latched position where the latch 131 engages the receiver 132 in the output media tray 130.

Figure 7:
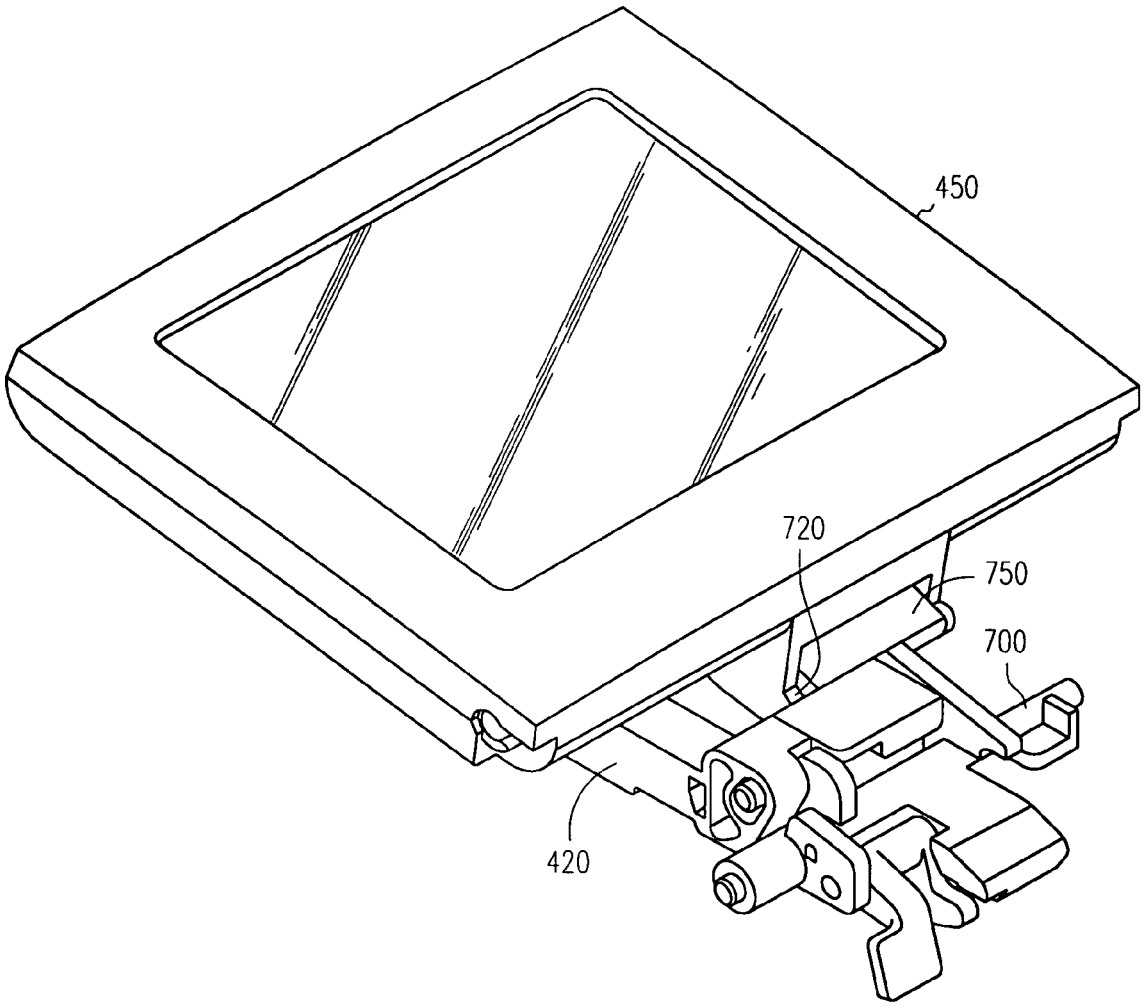
FIG. 7 is a perspective view of the front door latch and user interface elevation mechanism of an imaging apparatus, according to an example embodiment.

FIG. 7 includes aperspective view of the front door latch 430 and the user interface elevation mechanism 700 of the imaging apparatus 100, according to an example embodiment. The user interface or display elevation mechanism 700 includes the ramp 620 on the linkage arm 420 (see FIG. 6) and an elevator mechanism 750. The user interface or display 450 may be attached to the elevator mechanism 750. The elevator mechanism 750 includes a surface or portion 720 that engages the ramp 620 of the linkage arm 420. The elevator mechanism 750 is rotatably attached to the housing 140. The elevator mechanism 750 includes a step structure that engages the at least one détente in the housing 140. The step and detente may be shaped to overcome the force of a leaf spring when fully engaged. However, when the ramp 620 engages the surface or portion 720 of the elevator mechanism 750, the step disengages from the détente in the housing. The spring then urges the display toward the open or deployed position.

Figure 8:
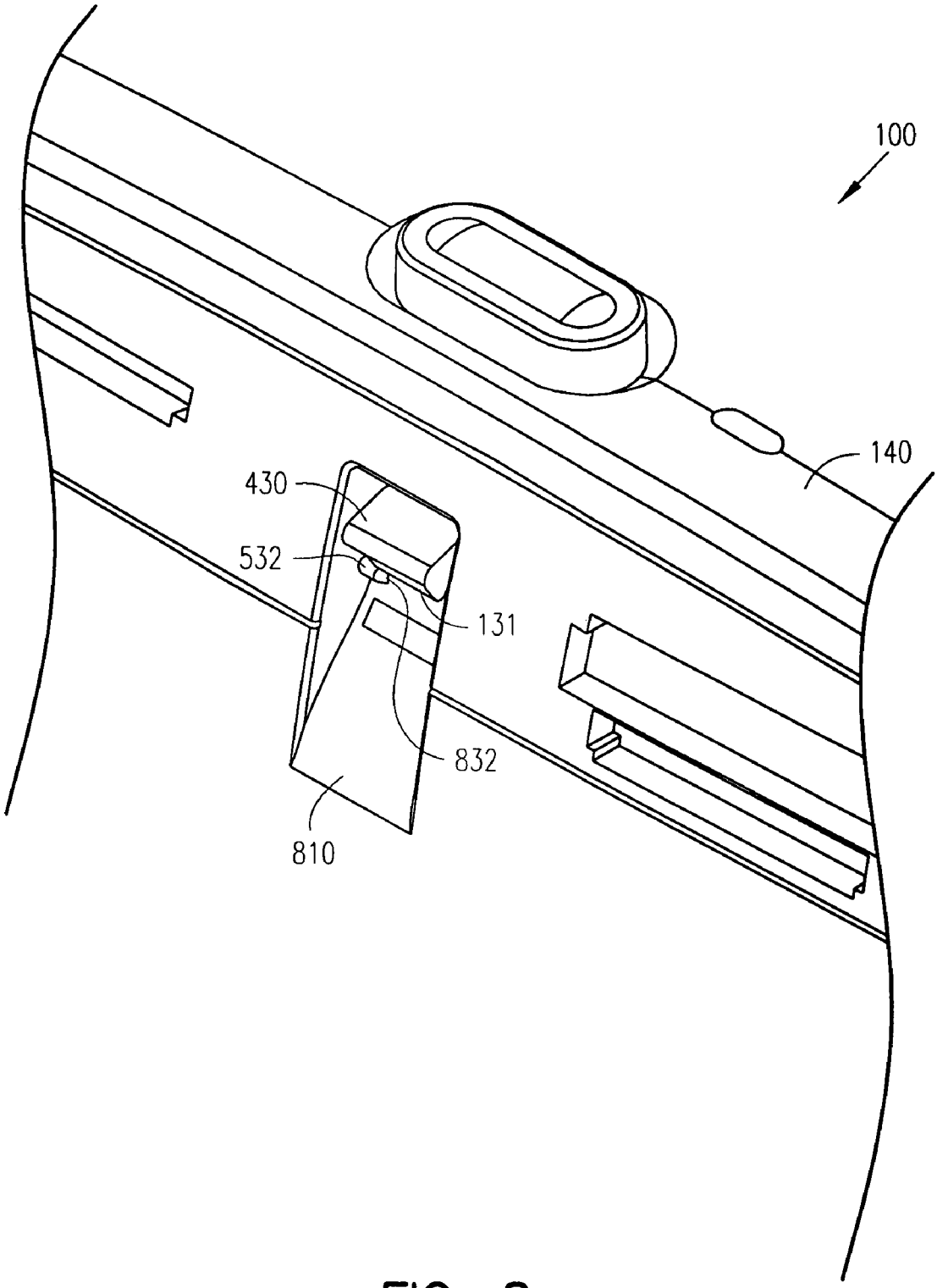
FIG. 8 is a perspective view of the housing of the imaging apparatus in the portion that includes the front door latch for the input media tray, according to an example embodiment.

FIG. 8 is a perspective view of the housing 140 of the imaging apparatus 100 that includes the front door latch 430 for the output media tray 130 (shown in FIG. 1), according to an example embodiment. The housing 140 includes an opening 832. The latch portion 131 of the front door latch 430 extends through the opening 832. The finger 532 of the sensor lever 530 extends through the opening 832. The opening 832, the finger 532 and the latch 131 of the front door latch are positioned within a recess 810 in the housing 140. It should be noted that the paddle 534 and the sensor lever switch 310 (see FIG. 5) are within the housing 140 and are substantially inaccessible from a position outside the housing 140.

Figure 9:
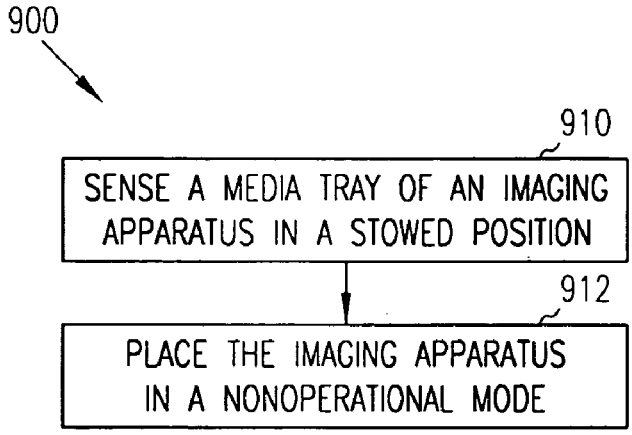
FIG. 9 is a flow diagram of a method of deploying elements of an imaging apparatus, according to an embodiment of the invention.

FIG. 9 is a flow diagram of a method 900 of placing the imaging apparatus 100 into a nonoperational mode, according to an example embodiment. The method includes sensing the media tray in a stowed position 910 and placing the imaging apparatus in a nonoperational mode 912. Now referring to FIGS. 3, 5 and 8, the operation of the imaging apparatus 100 with respect to the method 900 will be described in further detail. As the media tray, such as the output media tray 130, is moved to the stowed position, the finger 532 is moved into the housing 140. Moving the finger 532 causes the shaft 536 of the sensor lever mechanism 530 to rotate. The paddle 534 of the sensor lever mechanism 530 rotates and engages the sensor lever switch 310. The sensor lever switch 310, when depressed, moves the imaging apparatus 100 into a nonoperational state. One such nonoperational state includes disabling power to the imaging apparatus 100. As long as the media tray is stowed, the paddle 534 engages the sensor lever switch 310 and the imaging apparatus 100 remains in a nonoperational state. Once the media tray, such as the output media tray 130, is deployed or moved from the stowed position, the imaging apparatus is no longer prevented from switching to an operational state.

The imaging apparatus 100 also may include a device to substantially prevent operation of the imaging apparatus when the media tray 130, 120 is in the stowed position. In one embodiment, the device to substantially prevent operation of the imaging apparatus includes the switch 310 attached to the housing 140 of the imaging apparatus 100. The switch 310 disables power to the imaging apparatus 140. An element, such as the finger 532 of the sensor lever mechanism 530, is pivotally attached to the latch 430 for sensing the media tray 120/130 in the stowed position. The element, such as the paddle 534 or switch engaging member of the sensor lever mechanism 530, moves the switch 310. Together, the latch 420 and the switch 320 may also substantially prevent operation of the imaging apparatus.

Figure 10:
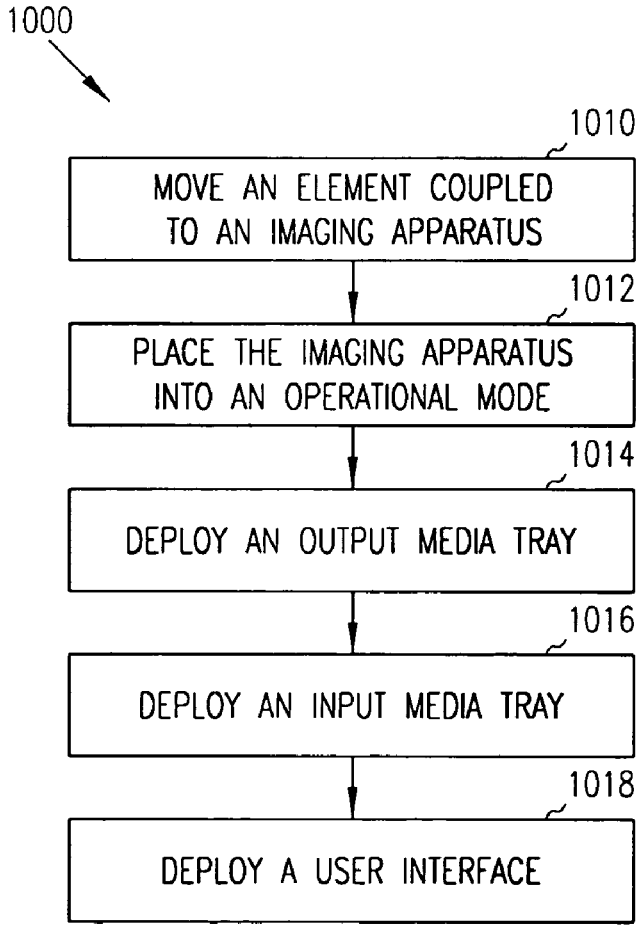
FIG. 10 is a flow diagram of a method of placing an imaging apparatus into a nonoperational mode, according to an embodiment of the invention.

FIG. 10 is a flow diagram of a method 1000 of deploying elements of an imaging apparatus, according to an embodiment of the invention. The method 1000 includes moving an element coupled to an imaging apparatus 1010, placing the imaging apparatus into an operational mode 1012, deploying an output media tray 1014, deploying an input media tray 1016, and deploying a user interface such as a display 1018. In one example embodiment, elements 1012-1018 may be accomplished substantially simultaneously.

In response to moving the linkage arm 420, a number of events may occur. In an embodiment, moving the linkage arm depresses the linkage arm switch 320, unlatches the input media tray 120 and the output media tray 130, and causes the ramp 650 to move the elevator mechanism 750 for the display or user interface 450. Unlatching the output media tray 130 releases the paddle 534 from the sensor lever switch 310 thereby no longer preventing the imaging apparatus from entering an operational mode or state. In one example embodiment, the output media tray 130 and the input media tray 120 are unlatched, power to the imaging apparatus is enabled, and the display is popped up away from the stowed position in response to moving the button actuator 106 coupled to the housing 140 of the imaging apparatus 100. In one embodiment, the output media tray is unlatched, the input media tray is unlatched, and power to the imaging apparatus is enabled substantially simultaneously in response to moving the actuator or button 106.

Although specific embodiments have been illustrated and described herein, those of ordinary skill in the art will appreciate that any arrangement calculated to achieve the same purpose can be substituted for the specific embodiments shown. This disclosure is intended to cover any and all adaptations or variations of various embodiments of the invention. It is to be understood that the above description has been made in an illustrative fashion, and not a restrictive one. Combinations of the above embodiments, and other embodiments not specifically described herein will be apparent to those of skill in the art upon reviewing the above description. The scope of various embodiments of the invention includes any other applications in which the above structures and methods are used. Therefore, the scope of various embodiments of the invention should be determined with reference to the appended claims, along with the full range of equivalents to which such claims are entitled.

It is emphasized that the Abstract is provided to comply with 37 C.F.R. § 1.72(b) to allow the reader to quickly ascertain the nature and gist of the technical disclosure. It is submitted with the understanding that it will not be used to interpret or limit the scope or meaning of the claims.

In the foregoing Description of Embodiments of the Invention, various features are grouped together in a single embodiment for the purpose of streamlining the disclosure. This method of disclosure is not to be interpreted as reflecting an intention that the claimed embodiments of the invention require more features than are expressly recited in each claim. Thus the following claims are hereby incorporated into the Description of Embodiments of the Invention, with each claim standing on its own as a separate embodiment.

What is claimed is:

1. An imaging apparatus comprising:
a housing having a cavity therein;
a linkage arm disposed within the cavity;
an input media tray movably latched to the housing; and
an input media tray latch coupled to the linkage arm and releasably engaged with the input media tray, wherein moving the linkage arm places the imaging apparatus in an operational mode, and releases the input media tray latch and unlatches the input media tray from the housing.

2. The imaging apparatus of claim 1 further comprising:
an output media tray movably latched to the housing; and
an output media tray latch coupled to the linkage arm and releasably engaged with the output media tray, wherein moving the linkage arm releases the output media tray latch and unlatches the output media tray from the housing.

3. The imaging apparatus of claim 2 wherein the output media tray moves to a deployed position when the output media tray latch is released and the output media tray is unlatched.

4. The imaging apparatus of claim 2 further comprising:
a sensing element rotatably attached to the output media tray latch, wherein the sensing element substantially prevents operation of the imaging apparatus when the output media tray is in a stowed position.

5. The imaging apparatus of claim 4 further comprising:
a first power switch positioned proximate the linkage arm; and
a second power switch positioned near the sensing element,
wherein moving the linkage arm contacts the first power switch with the linkage arm and contacts the second power switch with the sensing element.

6. The imaging apparatus of claim 4 wherein the sensing element comprises:
a shaft pivotally attached to the output media tray latch;
a finger coupled with the shaft; and
a paddle coupled with the shaft,
wherein when the output media tray is moved to the stowed position, the finger moves the shaft, the shaft moves the paddle, and the paddle contacts a switch, wherein the switch disables power to the imaging apparatus.

7. The imaging apparatus of claim 1 wherein the input media tray moves to a deployed position when the input media tray latch is released and the input media tray is unlatched.

8. The imaging apparatus of claim 1 further comprising:
a display movably attached to the housing; and
a ramp attached to the linkage arm and engaged with a portion of the display, wherein moving the linkage arm moves the ramp thereby moving the display.

9. The imaging apparatus of claim 1 further comprising:
a display movably attached to the housing; and
a ramp attached to the linkage arm and engaged with a portion of the display, wherein moving the linkage arm moves the ramp thereby moving the display to a deployed position.

10. An imaging apparatus comprising:
a housing;
a linkage arm movable within the housing;
an output media tray movably attached to the housing; and
an output media tray latch coupled to the linkage arm and releasably engaged with the output media tray, wherein moving the linkage arm places the imaging apparatus into an operational mode, and releases the output media tray latch and unlatches the output media tray from the housing.

11. The imaging apparatus of claim 10 wherein the output media tray latch is pivotally attached to the linkage arm.

12. The imaging apparatus of claim 10 further comprising:
a sensor lever coupled to the output media tray latch,
wherein the sensor lever places the imaging apparatus into a nonoperational mode when the output media tray is in a stowed position.

13. The imaging apparatus of claim 12 wherein the sensor lever contacts a switch when the output media tray is in the stowed position, wherein the switch disables power to the imaging apparatus.

14. The imaging apparatus of claim 12 wherein the sensor lever is pivotally attached to the output media tray latch.

15. The imaging apparatus of claim 14 wherein the sensor lever further comprises:
a shaft pivotally attached to the output media tray latch;
a finger attached to the shaft; and
a switch engaging member pivotally attached to the shaft, wherein when the output media tray is in the stowed position, the switch engaging member contacts a sensor lever switch associated with the housing to disable power to the imaging apparatus.

16. The imaging apparatus of claim 15 further comprising:
a linkage arm switch associated with the housing and positioned near the linkage arm, the linkage arm switch being different than the sensor lever switch.

17. The imaging apparatus of claim 16 wherein each of the linkage arm switch and the sensor lever switch disable power to the imaging apparatus.

18. The imaging apparatus of claim 10 further comprising:
an input media tray movably attached to the housing; and
an input media tray latch coupled to the linkage arm and releasably engaged with the input media tray, wherein moving the linkage arm places the imaging apparatus in an operational mode, and releases the input media tray and unlatches the input media tray from the housing.

19. The imaging apparatus of claim 18 further comprising:
an actuator coupled to the housing, wherein the actuator moves the linkage arm to unlatch the output media tray, unlatch the input media tray, and place the imaging apparatus in the operational mode.

20. The imaging apparatus of claim 19 wherein the output media tray is unlatched, the input media tray is unlatched, and the imaging apparatus is placed in the operational mode substantially simultaneously in response to moving the actuator.

21. An imaging apparatus comprising:

a housing;

a media tray attached to the housing and movable between a stowed position and a deployed position;

a latch coupled to the housing and adapted to latch die media tray in the stowed position;

means for substantially preventing operation of the imaging apparatus when the media tray is in the stowed position, the means for substantially preventing operation of the imaging apparatus including a switch attached to the housing, the switch disabling power to the imaging apparatus; and means pivotally attached to the latch for sensing the media tray in the stowed position and moving the switch.

22. The imaging apparatus of 21 wherein the media tray is an output media tray.

23. The imaging apparatus of 21 wherein the media tray is an input media tray.

24. An imaging apparatus comprising:

a housing;

a media tray attached to the housing and movable between a stowed position and a deployed position;

a latch coupled to the housing and adapted to latch the media tray in the stowed position;

a linkage arm coupled to the housing;

means for substantially preventing operation of the imaging apparatus when the media tray is in the stowed position; and means for enabling power to the imaging apparatus in response to moving the linkage arm, wherein the latch and the means for substantially preventing operation of the imaging apparatus are attached to the linkage arm.

* * * * *

UNITED STATES PATENT AND TRADEMARK OFFICE

CERTIFICATE OF CORRECTION

PATENT NO. : 7,398,968 B2
APPLICATION NO. : 10/978668
DATED : July 15, 2008
INVENTOR(S) : Murray Learmonth et al.

It is certified that error appears in the above-identified patent and that said Letters Patent is hereby corrected as shown below:

In column 9, line 5, in Claim 21, delete “die” and insert -- the --, therefor.

Signed and Sealed this

Fourteenth Day of October, 2008

JON W. DUDAS
*Director of the United States Patent and Trademark Office*